United States Patent [19]

Nishikubo et al.

[11] 4,280,210

[45] Jul. 21, 1981

[54] ELECTRONIC ALARM TIMEPIECE

[75] Inventors: Yasuhiko Nishikubo, Iruma; Mitsuo Sekine, Tokorozawa, both of Japan

[73] Assignee: Citizen Watch Co., Ltd., Tokyo, Japan

[21] Appl. No.: 948,633

[22] Filed: Oct. 3, 1978

[30] Foreign Application Priority Data

Oct. 3, 1977 [JP] Japan ..... 52/133025[U]
Dec. 14, 1977 [JP] Japan ..... 52/150010

[51] Int. Cl.[3] ..... G04B 23/02; G04C 21/16
[52] U.S. Cl. ..... 368/73; 368/251
[58] Field of Search ..... 58/19 R, 38 R, 57.5, 58/21.11, 21.12

[56] References Cited

U.S. PATENT DOCUMENTS 3,759,029 9/1973 Komaki ..... 58/21.12
4,001,553 1/1977 Troutman et al. ..... 58/23 R
4,068,461 1/1978 Fassett et al. ..... 331/116 FE
4,104,863 8/1978 Kondo ..... 58/19 R

*Primary Examiner*—Vit W. Miska
*Attorney, Agent, or Firm*—Birch, Stewart, Kolasch & Birch

[57] ABSTRACT

An electronic alarm timepiece comprises a quartz crystal oscillator, a frequency divider, a display driving means, a display means, an alarm signal shaping means and an alarm means. The alarm signal shaping means is so arranged that a pair of output signals which are opposite in phase are produced with the aid of output signals of the frequency divider for actuating the alarm means, whereby it is possible to provide an alarm signal shaping means in the form of a complementary metal oxide semiconductor (CMOS) integrated circuit having sufficient power to actuate the alarm means without other amplifying circuits.

2 Claims, 6 Drawing Figures

ELECTRONIC ALARM TIMEPIECE

BACKGROUND OF THE INVENTION

The present invention relates to a quartz crystal electronic alarm timepiece employing complementary metal oxide semiconductor (CMOS) integrated circuits, and more particularly to a quartz crystal electronic alarm timepiece comprising a quartz crystal oscillator producing a time standard signal, a frequency divider for dividing the frequency of the output signal of the oscillator to a frequency for a display means, and an alarm means with a buzzer.

The quartz crystal electronic timepiece with the alarm means comprises a driving means for a display means, an alarm signal shaping circuit for producing an output signal for driving a buzzer, and a means for checking coincidence of the displayed time with set time for producing an alarm gate control signal at a set time to actuate the buzzer. The alarm signal shaping circuit comprises a CMOS integrated circuit comprising a gate and a bipolar transistor amplifying circuit. It will be understood that the bipolar transistor circuit must be made as an independent circuit and attached to the CMOS integrated circuit.

SUMMARY OF THE INVENTION

It is one object of the present invention to provide an electronic alarm timepiece of which an alarm signal shaping circuit may be made in the form of a single CMOS integrated circuit having sufficient power to actuate an alarm means.

Another object of the present invention is to provide an electronic alarm timepiece which is of simplified construction and may be easily manufactured.

According to the present invention, there is provided an electronic alarm timepiece which comprises a quartz crystal oscillator for producing a time standard signal, a frequency divider connected to said quartz crystal oscillator for dividing the frequency of the output signal of said quartz crystal oscillator for producing a plurality of signals which are different in frequency, a driving means connected to said frequency divider for producing a display driving signal, a display driven by said display driving signal, an alarm setting means, means for comparing set time and displayed time in said display for producing an alarm gate control signal when the displayed time coincides with the set time, an alarm signal shaping means adapted to receive a plurality of output signals of the frequency divider for producing a pair of output signals of which the phases are opposite, an alarm means actuated by said opposite phase output signals, and gate means adapted to be actuated by the alarm gate control signal for controlling the actuation of the alarm means.

Further objects, features and advantages of the present invention will become apparent from the following description of preferred embodiments thereof, taken in conjunction with the accompanying drawings.

DESCRIPTION OF THE PREFERRED EMBODIMENTS

Figure 1:
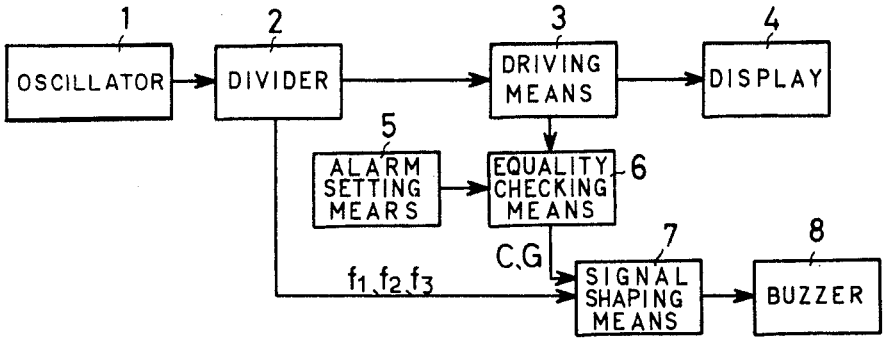
PRIOR ART Fig. 1
FIG. 1 is a block diagram showing a conventional electronic alarm timepiece.
Figure 2:
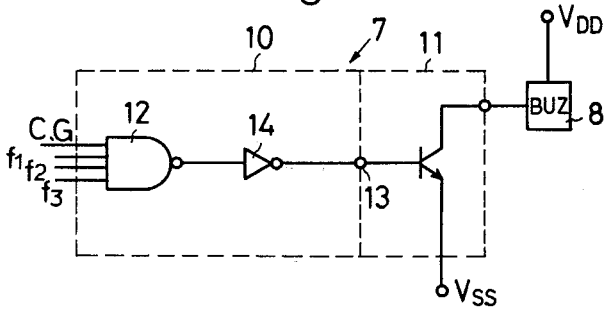
PRIOR ART Fig. 2
FIG. 2 is a block diagram showing a conventional alarm signal shaping means.

Referring to the drawings, FIG. 1 shows a block diagram of a conventional quartz electronic timepiece with alarm means, which comprises a crystal controlled oscilator 1, a frequency divider 2, a driving means 3 including counters for producing driving signal, a liquid crystal display 4 driven by the driving signal, an alarm setting means 5, an equality checking means 6, a buzzer driving signal shaping means 7, and a buzzer 8. The equality checking means 6 comprises an exclusive OR gate means for comparing the time signal from the counters of the driving means 3 and the set time signal from the alarm setting means 5. The exclusive OR gate means is adapted to generate a gate control signal C.G. when the time signal coincides with set time signal. The conventional buzzer driving signal shaping means 7 is shown in FIG. 2. The shaping means comprises a CMOS integrated circuit 10 and bipolar transistor 11. Three output signals $f_1$, $f_2$ and $f_3$ each of which has a suitable frequency are derived from the frequency divider 2 and applied to a NAND gate 12 of the CMOS integrated circuit 10. The gate control signal C.G. and output signal $f_1$, $f_2$, $f_3$ are combined by the NAND gate 12 to produce an output. The output is delivered from an output terminal 13 through an inverter 14. The output signals of the CMOS integral circuit 10 is amplified by the bipolar transistor 11 in order to drive the buzzer 8.

Thus, in the prior art, the buzzer driving signal shaping means 7 must be provided with a transistor 11 which is attached to the CMOS integrated circuit 10. The present invention provides an electronic alarm timepiece without the necessity for such an attached electronic device.

Figure 3:
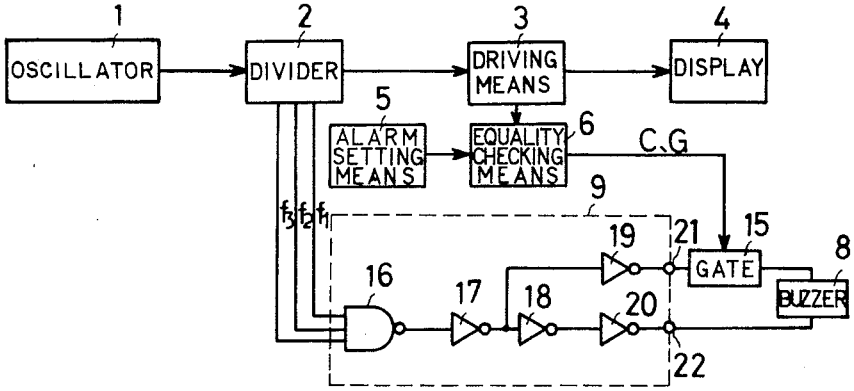
FIG. 3 is a block diagram showing an embodiment of the present invention.

Referring to FIG. 3, there is shown an embodiment of the present invention, in which the same parts as in FIG. 1 are identified with the same numerals. Numeral 9 designates a buzzer driving signal shaping means made in the form of a CMOS integrated circuit, which comprises a NAND gate 16, pre-driving inverters 17 and 18, and driving inverters 19 and 20. Three output signals $f_1$, $f_2$, $f_3$ of the divider 2 are applied to the NAND gate 16. In the case that the gate for the buzzer 8 is electronically controlled, gate control signal C.G. is used to control the gate provided in the means 9, and in the case where the gate is mechanically controlled, a mechanical switch or gate means 15 is provided between the buzzer 8 and output terminals 21 or 22 as shown in FIG. 3.

Output signal of the NAND gate 16 is applied to the inverters 18 and 19 through the inverter 17 and the output signal of the inverter 18 is applied to the inverter 20. Thus, output signals from the output terminals 21 and 22 are opposite in phase, which are applied to the buzzer 8 for actuation thereof. Each of the inverters 17 and 18 are geometrically designed to have a moderate power and each of the inverters 19 and 20 is designed to have a great power. Thus, the voltage difference between the output signals from the terminals 21 and 22 is varied from peak to peak and the value is twice the source voltage. Further, since the output impedance is low, the buzzer may be driven by the CMOS integrated circuit without a transistor amplifying means. If a thin-film piezoelectric buzzer is employed, the effect of the CMOS integrated circuit will be much greater, because such a buzzer may receive a substantial amount of energy in spite of its small volume.

Figure 4:
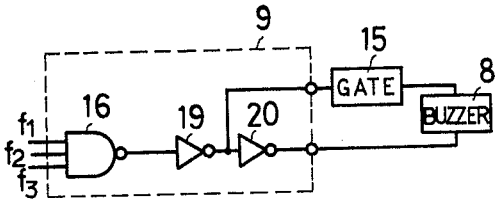
FIG. 4 is a block diagram showing a modified alarm signal shaping means.

FIG. 4 shows a buzzer driving means in accordance with another embodiment of the present invention. The means comprises the NAND gate 16, inverters 19 and 20 in the aforementioned embodiment without inverters 17 and 18. This example has an advantage similar to the above described embodiment. However, the former means of FIG. 3 is more advantageous than the latter, means, because reactive current may occur in the driving inverter 20 of FIG. 4, for example, due to deformation of waveform caused by the buzzer 8.

Figure 5:
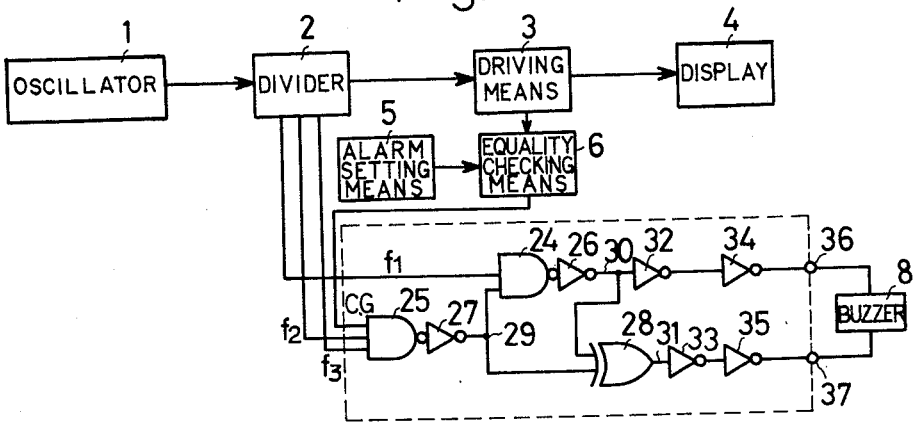
FIG. 5 is a block diagram showing another embodiment of the present invention.
Figure 6:
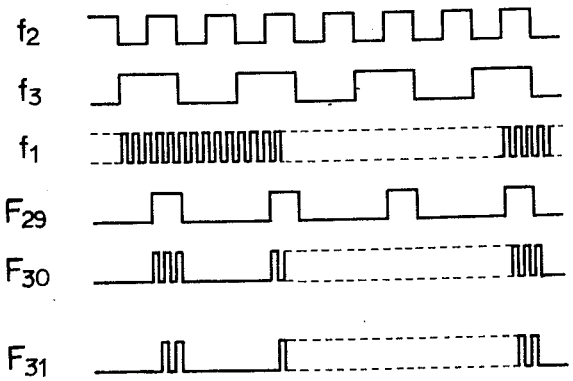
FIG. 6 shows waveforms at various locations in the circuit of FIG. 5.

FIG. 5 shows a buzzer driving means for further embodiment of the present invention, which has NAND gates 24, 25, inverters 26, 27 and exclusive OR gate 28. Output signal $f_1$ derived from the frequency divider 2 having a waveform $f_1$ in FIG. 6 is applied to the NAND gate 24, output signals $f_2$ and $f_3$, having waveforms $f_2$ and $f_3$ in FIG. 6 respectively, are applied to the NAND gate 25, and the gate control signal C.G. from the equality checking means 6 is also applied to the NAND gate 25. Output signal of the inverter 27 is applied to the NAND gate 24 and the exclusive OR gate 28, and the output signal of the inverter 26 is also applied to the exclusive OR gate.

FIG. 6 shows waveforms at various locations in the circuit of FIG. 5 at the time when the gate control signal C.G. of high level is received. Waveform F29 shows a signal at a junction point 29, waveform F30 shows signal on lead 30 and waveform F31 shows signal on lead 31. As may be seen, the signal waveform F29 on the junction point 29 is modulated by the signal $f_1$, so that the inverter 26 produces output signal F30 and the exclusive OR gate produces output signal F31. The output signals are generated in the duration of $1/f_2$ with the repetition period of $1/f_3$ and phases thereof are opposite to each other. The opposite phase output signals on lead 30 and 31 are transmitted through pre-driving inverters 32 and 33, driving inverters 34 and 35 to output terminals 36 and 37 to drive the buzzer 8.

When the gate control signal C.G. is not applied to the NAND gate 25, in-phase signals are produced on leads 30 and 31, so that the buzzer 8 is not driven.

In the embodiment, the control gate for controlling the buzzer is disposed in the CMOS integrated circuit, but it is possible to control the buzzer with outside means.

Further, the buzzer may be actuated by odd output signals which are somewhat staggered in opposite timing. This may be performed by modulating the CMOS integrated circuit.

From the foregoing it will be understood that the present invention may provide an electronic alarm timepiece of which alarm signal shaping circuit may be constructed with CMOS integrated circuit without transistor circuit to be attached, whereby the electronic timepiece may be manufactured with small electronic parts.

What is claimed is:

1. An electronic alarm timepiece comprising:

quartz crystal oscillator means for producing a time standard signal;

frequency divider means connected to said quartz crystal oscillator means for dividing the frequency of an output signal from said quartz crystal oscillator means for producing a plurality of signals, each of said signals being different in frequency;

driving means connected to said frequency divider means for producing a display driving signal;

display means driven by said display driving signal for indicating a display time;

alarm setting means for setting the alarm on said alarm timepiece;

comparing means responsive to an output signal from said alarm setting means and from said driving means for comparing the setting on said alarm setting means with the displayed time on said display means and for producing an alarm gate control signal when the displayed time coincides with the setting on said alarm setting means;

alarm driving means made in the form of a CMOS integrated circuit, said alarm driving means including:

means responsive to said alarm gate control signal for producing an alarm control signal having two modes of signals, first gate means responsive to the output signals from said frequency divider means and to one mode of said alarm control signal for producing a first alarm signal, second gate means responsive to the one mode of said alarm control signal and said first alarm signal for producing a second alarm signal having a phase which is opposite to the phase of said first alarm signal, said first and second gate means being arranged to produce in-phase signals in response to another mode of said alarm control signal, driving inverters responsive to said first and second alarm signal and to said in-phase signals for producing opposed-phase alarm driving signals and in-phase ineffective signals respectively; and alarm means responsive to said opposed-phase alarm driving signals for producing an alarm sound, said alarm means being non-responsive to said in-phase ineffective signals.

2. An electronic alarm timepiece in accordance with claim 1 wherein said alarm means comprises a thin-film piezoelectric buzzer.

* * * * *